United States Patent [19]

Freeman

[11] Patent Number: 4,684,179

[45] Date of Patent: Aug. 4, 1987

[54] SLIP RING ASSEMBLY FOR METHOD OF MAKING SAME

[76] Inventor: Jerry H. Freeman, 1100 W. Pendleton Pl., Mt. Prospect, Ill. 60056

[21] Appl. No.: 821,239

[22] Filed: Jan. 22, 1986

[51] Int. Cl.[4] ..... H01R 39/08; H01R 43/10

[52] U.S. Cl. ..... 439/27; 29/597; 310/232

[58] Field of Search ..... 339/5 R, 5 MS, 6 R, 339/8 R; 29/597; 310/232

[56] References Cited

U.S. PATENT DOCUMENTS

| | | | |
|---|---|---|---|
| 1,486,893 | 3/1924 | Himes | 310/232 |
| 2,322,011 | 6/1943 | French | 339/8 R |
| 3,091,714 | 5/1963 | Jernberg et al. | 310/232 |
| 3,289,140 | 11/1966 | Slack | 339/5 |
| 3,636,394 | 1/1972 | Forste | 310/232 |
| 4,209,213 | 6/1980 | Wussow | 339/5 R |
| 4,403,164 | 9/1983 | Preece | 310/232 |
| 4,535,264 | 8/1985 | Allport | 310/232 |

*Primary Examiner*—Eugene F. Desmond

*Attorney, Agent, or Firm*—Dressler, Goldsmith, Shore, Sutker & Milnamow, Ltd.

[57] ABSTRACT

A slip ring assembly for an alternator or like electrical apparatus is disclosed which is configured for efficient and accurate fabrication. The assembly includes a jig-like positioning member upon which first and second annular slip ring members, and respective first and second terminals, can be pre-assembled. These pre-assembled components are positionable within a molding assembly for formation of the body of the slip ring assembly.

16 Claims, 7 Drawing Figures

SLIP RING ASSEMBLY FOR METHOD OF MAKING SAME

TECHNICAL FIELD

The present invention relates generally to a slip ring assembly for mounting on the rotor shaft of an alternator or like electrical apparatus, and more particularly to a slip ring assembly which is configured to facilitate efficient and accurate formation thereof. A method of making the present slip ring assembly is also disclosed.

BACKGROUND OF THE INVENTION

A slip ring assembly is typically provided on the rotatable rotor shaft of an automobile alternator or like electrical generating apparatus for effecting electrical contact between the rotor of the apparatus and the associated, relatively fixed electrical contact brushes. Such an assembly typically includes an electrically non-conductive body which carries a pair of axially spaced, annular members referred to as slip rings. A pair of terminals are provided which are respectively electrically joined to the slip rings, with the terminals typically extending axially together from one end of the assembly for connection to the windings of the rotor assembly. The slip rings are typically positioned for respective electrical contact with a pair of the relatively fixed, non-rotating contact brushes to provide the desired electrical connection between the brushes and rotor assembly.

In the past, slip ring assemblies of the above type have typically been manufactured by a compression molding process. Specifically, each of the annular slip rings of the assembly is formed and joined to a respective one of the pair of terminals. Each slip ring and its terminal are then positioned within a mold cavity, with the slip rings positioned in the desired axially spaced relation. A charge of electrically non-conductive moldable material is then introduced into the mold cavity, and the mold cavity is closed and the material compressed to form the body of the slip ring assembly within and about the slip rings and terminals. The body portion of the assembly is typically formed with an axial bore to facilitate mounting of the assembly on an associated rotor shaft, with the body portion acting to electrically insulate the slip rings from each other while maintaining them in the desired axially spaced relation.

In order to assure long and reliable service life, it is desirable that slip ring assemblies be manufactured to exhibit relatively small manufacturing tolerances. In this regard, however, the above compression molding technique has been found to be somewhat disadvantageous in providing highly consistent and accurate molding.

It is therefore desirable to provide a slip ring assembly which facilitates efficient and consistent manufacture, thus desirably enhancing the overall efficiency of the manufacturing process. The slip ring assembly of the present invention has been particularly configured with the goals of efficient and consistent manufacture, with a method of making the present slip ring assembly disclosed herein which can be efficiently performed by taking advantage of well-developed injection-molding techniques.

SUMMARY OF THE INVENTION

A slip ring assembly embodying the principles of the present invention has been particularly configured for efficient and accurate fabrication. To this end, the assembly includes a one-piece, jig-like fixture or positioning member which facilitates "pre-assembly" of a number of the components of the slip ring assembly. This pre-assembly can subsequently be positioned in a molding apparatus for completing fabrication, preferably by injection-molding, although compression molding can be alternatively employed.

The slip ring assembly of the present invention is configured for mounting on a rotatable rotor shaft of an electrical apparatus, such as an alternator, having a pair of relatively fixed contact brushes. The assembly includes an electrically non-conductive, generally annular positioning member which defines first and second axially spaced outer, peripheral surfaces. The positioning member preferably includes a relatively enlarged, generally circumferential land between the first and second peripheral surfaces, with the land acting to electrically insulate the slip ring members susbsequently positioned on the positioning member.

The present slip ring assembly further includes first and second electrically-conductive annular slip ring members which are respectively positioned on the first and second outer peripheral surfaces of the positioning member. The slip ring members are thus positioned in axially spaced relation with respect to each other, and are thus arranged for respective contact with the non-rotating brushes of the associated electrical apparatus.

The slip ring assembly further includes first and second electrically-conductive terminals respectively electrically joined to the first and second slip ring members. The terminals are preferably diametrically opposed with respect to the rotational axis of slip ring assembly. The terminals extend together in a direction axially of the slip ring members, with the first terminal extending from the first slip ring member in inwardly spaced relation to the second slip ring member. These terminals are configured for electrical connection with the windings of the associated rotor assembly of the electrical apparatus which incorporates the slip ring assembly.

The slip ring assembly of the present invention further comprises an electrically non-conductive body formed generally inwardly of the positioning member and on axially opposite ends of the first and second slip ring members to provide an essentially permanently integrated assembly. The body defines an axial bore for receiving the rotor shaft of the associated electrical apparatus therein for mounting of the slip ring assembly on the rotor shaft.

In accordance with the present invention, the body of the slip ring assembly is formed by molding the body about a "pre-assembly" of the positioning member, the slip ring members, and the terminals. The body thus acts to bond and integrate the various components. To this end, the present method contemplates positioning of the pre-assembled components within the cavity of a molding apparatus, with the axially extending terminals respectively received within means provided within the mold assembly, somewhat in the nature of the manner in which an electrical plug is fit into a plug socket. Highly accurate positioning of the pre-assembled components within the mold assembly is facilitated by configuring the molding apparatus to engage annular edge portions of the slip ring members. The mold assembly thus engages and bears against the pre-assembled slip rings such that subsequent molding of the body is effected with desirably high accuracy. This arrangement results in formation of the opposite end portions of the molded body with an outside diameter which is slightly greater than the outside diameter of the annular slip ring members.

Numerous other features and advantages of the present invention will become readily apparent from the following detailed description, the accompanying drawings, and the appended claims.

DETAILED DESCRIPTION

Figure 1:
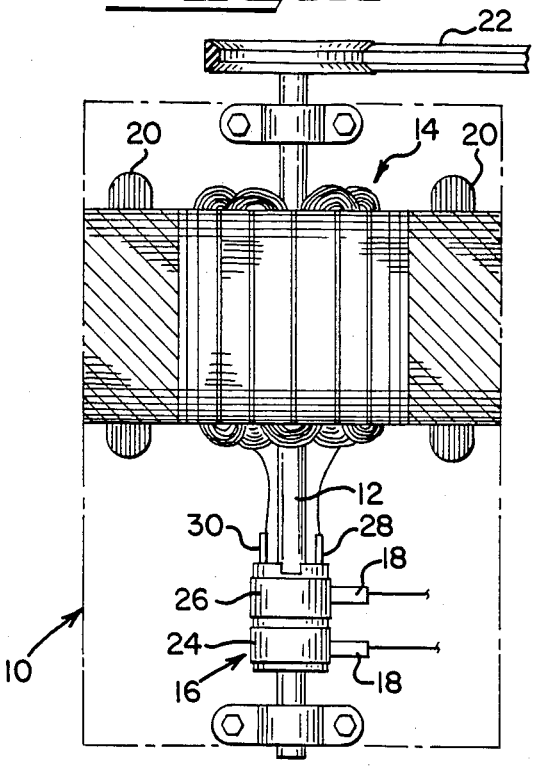
FIG. 1 is a simplified diagrammatic view of an electrical apparatus shown as an alternator having a slip ring assembly embodying the principles of the present invention.
Figure 3:
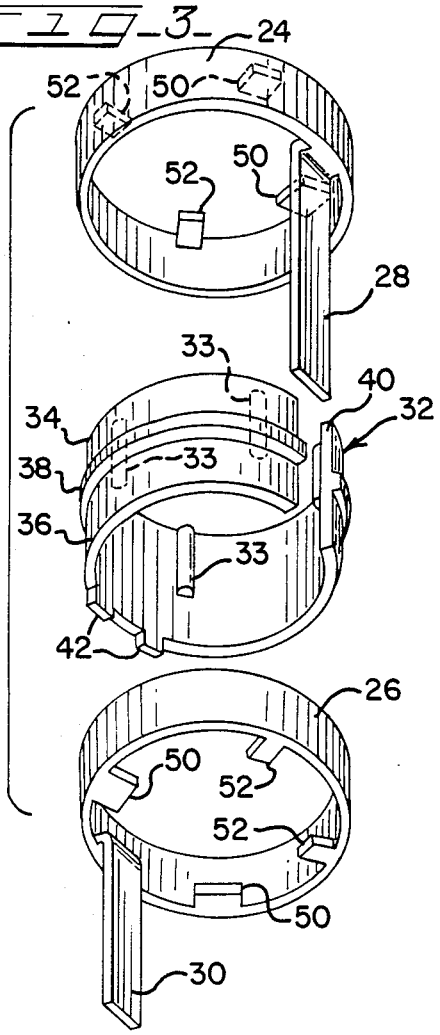
FIG. 3 is an exploded perspective view of components of the present slip ring assembly which are pre-assembled for subsequent molding of a body portion of the slip ring assembly.
Figure 2:
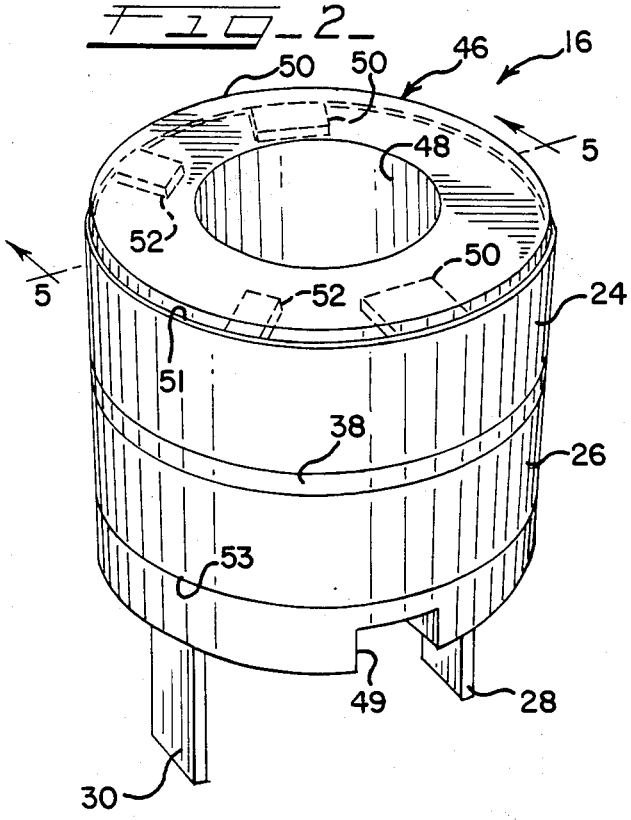
FIG. 2 is a relatively enlarged perspective view of the slip ring assembly shown in FIG. 1.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

For purposes of clarity in the present disclosure, terms such as "upper" and "lower" have been employed with particular reference to the appended drawings. It is to be understood that such terms of spatial orientation are not intended to limit the present invention to such specifically indentified orientations.

With reference first to FIG. 1, therein is illustrated a simplified form of an electrical apparatus comprising an alternator 10. As will be recognized by those familiar with the art, alternator 10 typically includes a rotatable rotor shaft 12 which carries a rotor assembly 14 comprising a core and windings. A slip ring assembly 16 embodying the principles of the present invention is further mounted on the rotor shaft 12 for rotation therewith, and is provided for effecting an electrical connection between the winding of rotor assembly 14 and a pair of relatively fixed, non-rotatable contact brushes 18. For purposes of illustration, alternator 10 has been shown as including stator coils 20, with generation of electrical current effected by high speed rotation of rotor shaft 12 such as by drive belt 22. In an automobile alternator, for which the present slip ring assembly 16 is particularly adapted, rotational speed is typically on the order of 12,000 rpm.

With particular reference to FIGS. 2–5, slip ring assembly 16 includes first and second electrically-conductive, annular slip ring members 24 and 26 which are configured for respective electrical contact with brushes 18 of alternator 10. Slip ring members 24 and 26 can be formed from suitably electrically-conductive metallic material such as copper or the like. Assembly 16 further includes a pair of diametrically opposed first and second electrically-conductive terminals 28 and 30 which are respectively electrically joined to the first and second slip ring members 24 and 26. It is presently preferred that terminals 28 and 30 be formed integrally with, or be otherwise suitably joined to, the respective slip ring members 24 and 26 prior to subsequent assembly of the various components.

In accordance with the present invention, slip ring assembly 16 further includes a one-piece, electrically non-conductive positioning member 32. Positioning member 32 can be readily and efficiently formed by conventional injection-molding techniques, and in this regard, the positioning member is preferably provided with a plurality of circumferentially spaced knock-out pads 33 on its interior surface. Knock-out pads 33 provide surfaces engaged by suitable ejector pins or the like which are employed for ejecting the positioning member from the mold in which it is formed, thus desirably avoiding unacceptable deformation of the member 32 attendant to such mold ejection.

As noted above, positioning member 32 functions in the nature of a jig or fixture for positioning the slip ring members 24 and 26 and their respective terminals during fabrication of the slip ring assembly. To this end, positioning member 32 defines first and second axially spaced, outer peripheral surfaces 34 and 36, with the surfaces 34 and 36 configured to respectively receive slip ring members 24 and 26 thereon. The surfaces 34 and 36 are preferably sized to provide an interference fit with slip ring members 24 and 26 so that the slip ring members are held in position on the positioning member 32. In the preferred form, positioning member 32 is provided with a relatively enlarged, generally cirumferential land 38 positioned between surfaces 34 and 36 for electrically insulating slip ring members 24 and 26 from each other.

Figure 4:
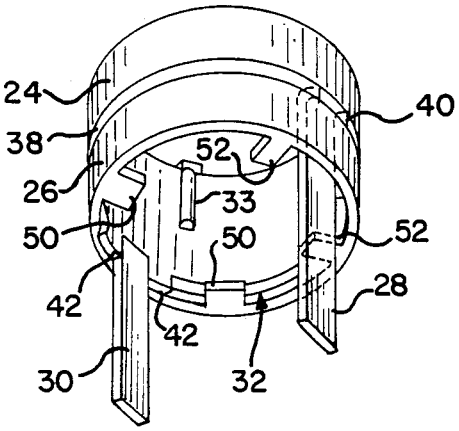
FIG. 4 is a perspective view illustrating a pre-assembly of the components shown in FIG. 3.

Slip ring member 24 and its terminal 28, and slip ring member 26 and its terminal 30 are configured to be fitted to generally opposite ends of positioning member 32 to provide the pre-assembly of components shown in FIG. 4. To facilitate assembly in this manner, positioning member 32 preferably defines an axially extending opening 40 aligned with first terminal 28 such that the terminal 28 extends through the opening 40 when slip ring 24 is positioned on surface 34 of the positioning member. As will be appreciated, the configuration of axial opening 40 in the illustrated embodiment results in the positioning member being discontinuous, and thus the positioning member has been described as being generally annular. Similarly land 38 has been described as being generally circumferential. While opening 40 has been illustrated as extending substantially the length of positioning member 32, it will be appreciated that the opening need not extend the full length while still being configured to facilitate positioning of first slip ring member 24 and its terminal 28 on the positioning member 32.

In order to facilitate positioning of second terminal 30 in diametrically opposed relation to the first terminal 28, positioning member 32 preferably includes means for receiving the second terminal 30, with such receiving means provided by a pair of spaced projections 42 between which the second terminal is received.

Ths slip ring assembly 16 further includes a body 46 which is formed generally inwardly of positioning member 32, and on generally axially opposite ends of the slip rings 24 and 26. Body 46 defines an axial bore 48 which is configured to receive the rotor shaft 12 of the associated alternator 10 for mounting of the slip ring assembly on the rotor shaft. Body 46 may be formed with a keyway 49 for receiving a suitable key (not shown) provided on rotor shaft 12.

Notably, the present slip ring assembly has been configured for high structural integrity such that any relative rotation between slip ring members 24 and 26 and body 46 is substantially prevented. To this end, each of the slip ring members 24 and 26 is preferably provided with a plurality of circumferentially spaced inwardly extending locking tabs 50, 52 which extend into and are substantially embedded in the opposite end portions of body 46. Several features of the arrangement should be noted. To promote the rotational balance of the finished slip ring assembly 16, the four illustrated locking tabs 50, 52 of each slip ring are spaced evenly from each other as well as from the respective terminal 28, 30, i.e., in the illustrated embodiment at 72 degrees relative spacing. The locking tabs are preferably formed to be spaced slightly from the edges of positioning member 32, with the slip rings 24 and 26 thus each engaging circumferential band 38 for accurate positioning. The smaller size of tabs 52 relative to tabs 50 desirably avoids dielectric failure of the assembly by positioning tabs 52 of second slip ring member 26 at a sufficient distance from first terminal 28 which extends through second slip ring member 26 (see FIG. 4).

To further facilitate accurate and consistent manufacture of slip ring assembly 16, it is presently contemplated that the molding apparatus in which body 46 is formed be configured to engage and bear against annular edge portions of the slip ring members 24 and 26. Accordingly, body 46 of assembly 16 is preferably closely spaced inwardly of the outside diameter of the slip ring members 24 and 26 so that continuous annular edge portions 51 and 53 of slip ring members 24 and 26, respectively, extend just outwardly of the end portions of body 46. Thus, the end portions of body 46 respectively adjacent axially opposite edges of the slip ring members have an outside diameter that is slightly less than the outside diameter of slip ring members 24 and 26.

Figure 5:
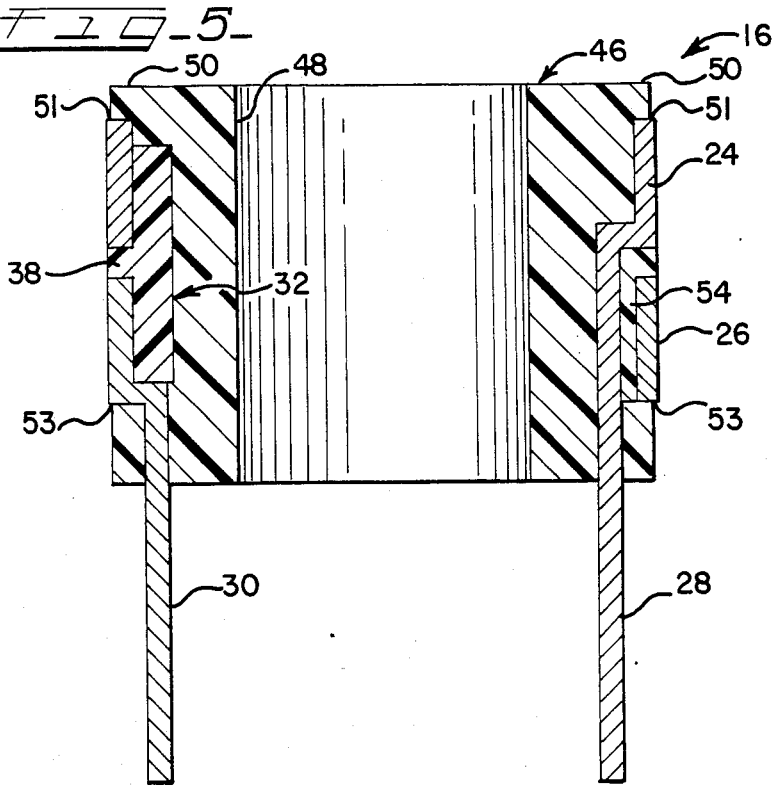
FIG. 5 is a cross-sectional view of the present slip ring assembly taken along line 5-5 of FIG. 2.
Figure 6:
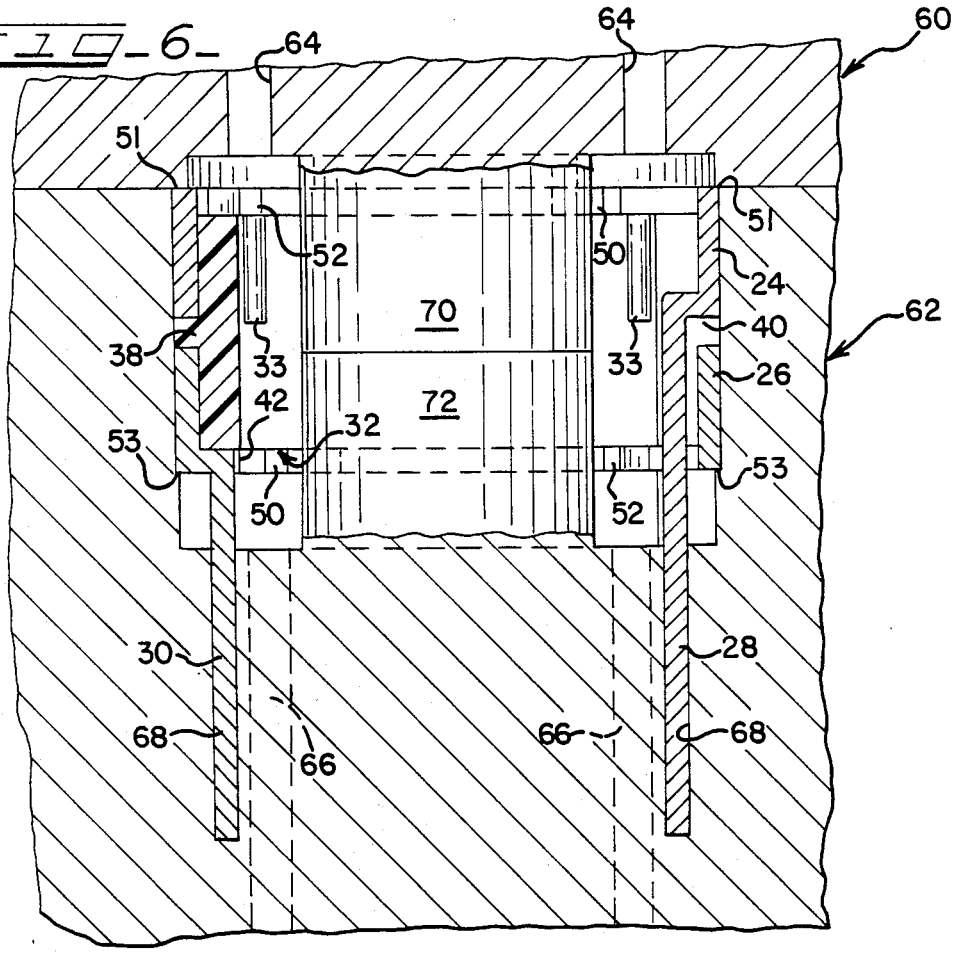
FIG. 6 is a diagrammatic, cross-sectional view of a mold assembly showing the pre-assembled components of FIG. 4 positioned therein.

As noted above, positioning member 32 in the illustrated embodiment defines the opening 40 aligned with first terminal 28. As best shown in FIGS. 5 and 6, terminal 28 extends axially of first slip ring member 24 in radially inwardly spaced relation to second slip ring member 26. In order to electrically insulate the first terminal 28 from the second slip ring member 26 at the opening 40, the body 46 of the slip ring assembly includes an insulating portion 54 formed within opening 40 between terminal 28 and second slip ring member 26. This insulating portion, as well as the remaining portions of body 46, are formed integrally during molding of the body portion, as will now be described.

Figure 7:
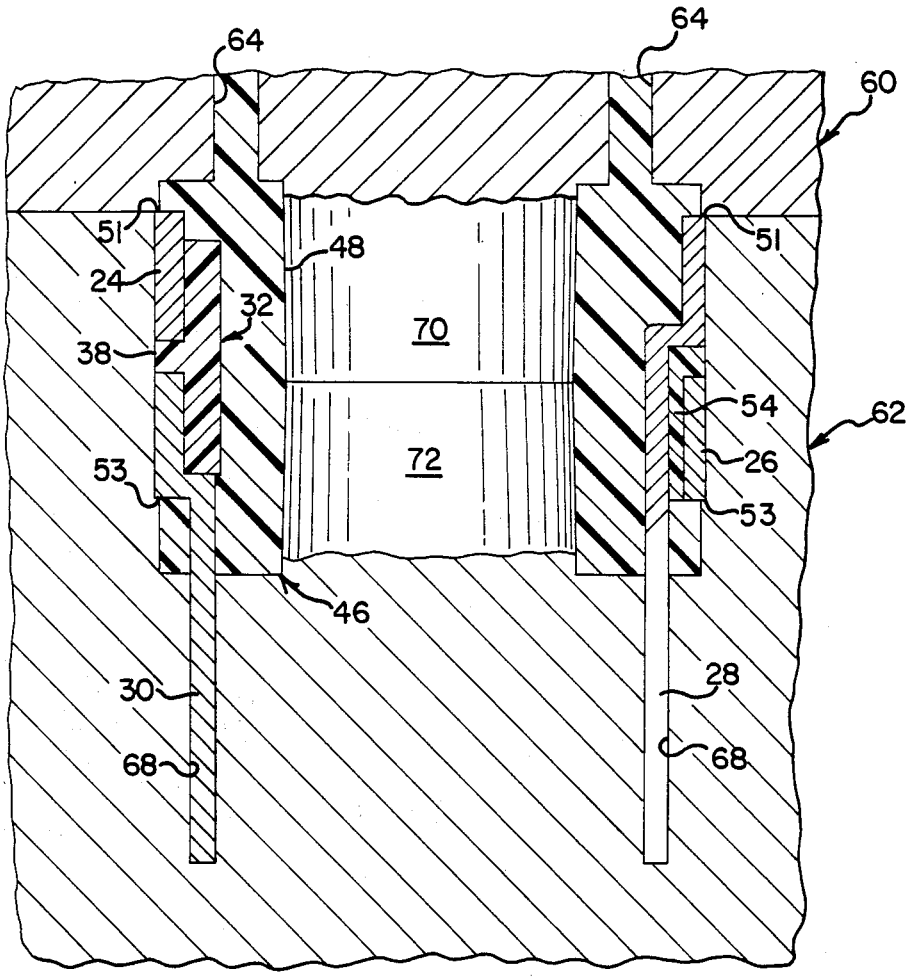
FIG. 7 is a view similar to FIG. 6 showing molding of the body portion of the slip ring assembly.

Referring particularly to FIGS. 6 and 7, therein is illustrated a molding apparatus shown as an injection-molding assembly for forming slip ring assembly 16 in accordance with the present method. As will be recognized by those familiar with the art, the injection-molding assembly is shown in a generally simplified, diagrammatic form, and can be configured other than as specifically disclosed. Generally, the features of the mold assembly, as will be described, are arranged to facilitate convenient and accurate positioning of the pre-assembled components shown in FIG. 4 (i.e., positioning member 32, slip ring members 24 and 26, and their respective terminals 28 and 30) within the mold assembly for formation of body 46. As will be recognized, body 46 of the slip ring assembly can also readily be formed by compression molding techniques in practicing the present invention, but formation by injection-molding is presently preferred.

In the illustrated embodiment, the mold assembly is shown as including an upper mold portion generally designated 60, and a lower mold portion generally designated 62, which together define a mold cavity. Introduction of suitable moldable material into the cavity can be effected in a conventional fashion such as via gates 64 in the upper mold portion 60. If body 46 is to be compression molded, a "charge" of suitable moldable material is introduced into the mold cavity prior to closing of the mold assembly. Ejection of the finished slip ring assembly 16 from the mold cavity can also be effected in a conventional fashion, such as by the provision of ejector pins 66 in the lower mold portion 62 (see FIG. 6).

For formation of body 46 of the slip ring assembly, the pre-assembled components of the assembly are positioned within lower mold portion 62. Lower mold portion 62 preferably defines means for receiving the diametrically opposed terminals 28 and 30, and thus defines a pair of terminal receiving openings 68 within which the terminals 28 and 30 are respectively received, somewhat in the nature of the manner in which an electrical plug is fitted into a socket.

At least one of the upper and lower mold portions 60 and 62 is preferably provided with suitable core pin means for formation of the axial bore 48 within body 46 of the slip ring assembly. In the illustrated embodiment, each of the upper and lower mold portions 60 and 62 is provided with a respective one of a pair of cooperating core pins 70 and 72 thus desirably minimizing the draft angle of the core pins.

The desired accurate positioning of the pre-assembled components of the present slip ring assembly within the mold assembly is facilitated by the manner in which upper and lower mold portions 60 and 62 are preferably configured to respectively engage and bear against annular edge portions 51 and 53 of the slip ring members 24 and 26. The subsequent molding of body 46 is thus effected with a high degree of accuracy. Such molding of the body 46 is shown in FIG. 7, with moldable material introduced into the mold cavity via gates 64. Suitably heat-resistant nylon or the like can readily be employed.

During molding in this manner, the moldable material flows generally about positioning member 32, slip ring members 24 and 26, and terminals 28 and 30, filling all of the voids in the mold cavity so as to bond and integrate the various components. The locking tabs 50, 52 are substantially embedded in the end portions of the body 46, with plastic material flowing within the opening 40 defined by positioning member 32 to form insulating portion 54 between second slip ring member 26 and first terminal 28.

Upon sufficient solidification of the body 46, the mold assembly can be opened and the now-formed slip ring assembly 16 ejected therefrom. Manufacture of the present slip ring assembly is now essentially completed. In a current embodiment, a slip ring assembly having a diameter of approximately one inch, and a body length of approxiamtely one inch (with terminals 28 and 30 extending beyond the body by approximately fiveeights inches) has been successfully fabricated by the above method.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. It is, of course, intended to cover by the appended claims all such modifications as fall with the scope of the claims.

What is claimed is:

1. A slip ring assembly for mounting on a rotatable rotor shaft of an eletrical apparatus having relatively fixed contact brush means, comprising:

an electrically non-conductive, generally annular positioning member defining first and second axially spaced outer, peripheral surfaces;

first and second electrically-conductive annular slip ring members respectively positioned on said first and second outer peripheral surfaces of said positioning member, said first and second slip ring members being positioned for contact with said brush means;

first and second electrically-conductive terminals respectively electrically joined to said first and second slip ring members, said terminals extending together in a direction axially of said slip ring members, said first terminal extending from said first slip ring member in inwardly spaced relation to said second slip ring member; and an electrically non-conductive body formed generally inwardly of said positioning member and on axially opposite ends of said slip ring members, said body defining an axial bore for receiving said rotor shaft therein for mounting said slip ring assembly on said rotor shaft.

2. A slip ring assembly in accordance with claim 1, wherein said positioning member includes generally circumferential land means between said first and second peripheral surfaces thereof for electrically insulating said first and second slip ring members from each other.

3. A slip ring assembly in accordance with claim 2, wherein said positioning member defines an axially extending opening aligned with said first terminal.

4. A slip ring assembly in accordance with claim 3, wherein said positioning member further includes means for receiving a portion of said second terminal.

5. A slip ring assembly in accordance with claim 2, wherein said first and second terminals are diametrically opposed.

6. A slip ring assembly in accordance with claim 1, wherein said slip ring members each include integral locking tab means extending into and substantially embedded in said body of said assembly.

7. A slip ring assembly in accordance with claim 1, wherein opposite end portions of said body respectively adjacent to axially opposite edges of said slip ring members have an outside diameter less than the outside diameter of said slip ring members.

8. A slip ring assembly for mounting on a rotatable rotor shaft of an electrical apparatus having relatively fixed contact brush means, comprising:

an electrically non-conductive, generally annular positioning member defining first and second axially spaced outer peripheral surfaces, said positioning member including a generally circumferential land between said first and second peripheral surfaces;

first and second electrically-conductive annular slip ring members respectively positioned on said first and second outer peripheral surfaces of said positioning member whereby said slip ring members are positioned for contact with said brush means;

first and second electrically-conductive terminals respectively electrically joined to said first and second slip ring members in diametrically opposed relation, said first and second terminals extending together in a direction axially of said slip ring members, said first terminal extending in inwardly spaced relation to said second slip ring member; and an electrically non-conductive body formed generally inwardly of said positioning member and having end portions on axially opposite ends of said slip ring members, said body defining an axial bore for receiving said rotor shaft therein for mounting said slip ring assembly on said rotor shaft, said first and second slip ring members each including integral locking tab means extending into said body for locking said slip ring members against rotation relative to said body.

9. A slip ring assembly in accordance with claim 8, wherein said opposite end portions of said body have an outside diameter less than the outside diameter of said slip ring members.

10. A slip ring assembly in accordance with claim 8, wherein said locking tab means of said slip ring members are positioned relative to said first and second terminals for rotational balance of said slip ring assembly.

11. A method of forming slip ring assembly for mounting on a rotatable rotor shaft of an electrical apparatus having fixed contact brush means, comprising the steps of:

providing an electrically non-conductive, generally annular positioning member defining first and second axially spaced outer peripheral surfaces and generally circumferential land means between said peripheral surfaces;

providing first and second electrically-conductive annular slip ring members, and first and second electrically-conductive terminals respectively electrically joined to said first and second slip ring members;

positioning said first and second slip ring members on said first and second peripheral surfaces of said positioning member for contact with said brush means such that said terminals extend together in a direction axially of said slip ring members; and molding an electrically non-conductive body generally within said positioning member and on axially opposite ends of said slip ring members to form said slip ring assembly, including molding said body to define an axial bore for receiving said rotor shaft for mounting said slip ring assembly on said rotor shaft.

12. A method of forming a slip ring assembly in accordance with claim 11, wherein said molding step includes injection-molding said body.

13. A method of forming a slip ring assembly in accordance with claim 11, wherein said molding step includes providing upper and lower mold means, and placing said positioning member with said slip ring members and said terminals in position thereon in said lower mold means, and subsequently molding said body.

14. A method of forming a slip ring assembly in accordance with claim 11, including providing means in said lower mold means for respectively receiving said first and second axially extending terminals.

15. A method of forming a slip ring assembly in accordance with claim 14, wherein at least one of said upper and lower mold means includes core pin means for forming said axial bore of said body during said injection-molding.

16. A method of forming a slip ring assembly in accordance with claim 13, including respectively engaging said upper and lower mold means with annular edge portions of said first and second slip ring members to form said body with opposite end portions having an outside diameter less than the outside diameter of said slip ring members.

* * * * *